US008470167B2

(12) United States Patent
Bartolini

(10) Patent No.: US 8,470,167 B2
(45) Date of Patent: Jun. 25, 2013

(54) DEVICE FOR DOSED TRANSFER OF FILTERED SOFTENED WATER INSIDE BOILERS OF STEAM HOUSEHOLD APPLIANCES

(75) Inventor: Villelmo Bartolini, Foligno (IT)

(73) Assignee: Unitekno Societa'per Azioni, Foligno (PG) (IT)

( * ) Notice: Subject to any disclaimer, the term of this patent is extended or adjusted under 35 U.S.C. 154(b) by 287 days.

(21) Appl. No.: 12/804,118

(22) Filed: Jul. 14, 2010

(65) Prior Publication Data

US 2011/0017652 A1 Jan. 27, 2011

(30) Foreign Application Priority Data

Jul. 23, 2009 (IT) ..... MC2009A0174

(51) Int. Cl.
*B67D 7/76* (2010.01)

(52) U.S. Cl.
USPC ..... 210/116; 210/172.1; 210/245; 210/282; 210/429; 210/472; 222/189.06; 222/442; 222/449

(58) Field of Classification Search
USPC ..... 210/116, 172.1, 235, 245, 282, 418, 210/429, 472, 502.1; 141/69, 292, 309; 222/189.06, 442, 449
See application file for complete search history.

(56) References Cited

U.S. PATENT DOCUMENTS

| | | | | | |
|---|---|---|---|---|---|
| 2,680,773 | A | * | 6/1954 | Rappuhn, Sr. | 429/78 |
| 2,746,663 | A | * | 5/1956 | Day et al. | 141/59 |
| 2,761,833 | A | * | 9/1956 | Ward | 210/85 |
| 3,207,190 | A | * | 9/1965 | Silbereis et al. | 141/198 |
| 5,238,559 | A | * | 8/1993 | Nieweg | 210/264 |
| 5,507,108 | A | | 4/1996 | Bruggink et al. | 38/77.8 |

FOREIGN PATENT DOCUMENTS

| | | | |
|---|---|---|---|
| DE | 198 50 472 A1 | 5/2000 | |
| EP | 0 306 623 A1 | 3/1989 | 75/14 |

* cited by examiner

*Primary Examiner* — Matthew O Savage
(74) *Attorney, Agent, or Firm* — Lowe Hauptman Ham & Berner, LLP

(57) ABSTRACT

A device for the dosed transfer of filtered softened water inside boilers of household appliances includes a tank, a cartridge including a water softening agent, a double drain pipe with vertical axis. The double drain pipe is formed of an adjacent pair of conduits and situated downstream a drain hole configured to be closed by a shut-off plate which is normally closed by the return action of a spring

11 Claims, 4 Drawing Sheets

DEVICE FOR DOSED TRANSFER OF FILTERED SOFTENED WATER INSIDE BOILERS OF STEAM HOUSEHOLD APPLIANCES

The present patent application for industrial invention relates to a device for the dosed transfer of filtered softened water inside boilers of steam household appliances, such as steam irons or steam cleaners.

As it is known, this type of household appliances is provided with a boiler to generate water vapour, which must be filled with distilled water or low-calcium water, in order to avoid formation of dangerous scale deposits, which would rapidly impair the efficient operation of the appliance, requiring frequent cleaning and descaling operations.

It is also known that in order to generate steam efficaciously, a certain amount of water must be introduced in the boiler, which is lower than the total volume of the boiler, being the residual volume necessary to receive the steam that is generated.

Devices are known to introduce the correct amount of water in the boiler, interrupting supply at the desired level, said devices being often provided together with the steam appliances. Moreover, water softening devices are known, being generally designed for food consumption, typically jugs. If the appliance is provided with a cold tank and pressurized boiler filling with a pump, filtering systems are also known, being installed between the cold tank and the boiler, and being frequently used in coffee machines.

The limitations of the known devices consist in the fact that if the user wants to pour softened water using a dosing device, the water should be softened first with another device (jug, for example). Alternatively, expensive distilled or demineralized water should be purchased.

Moreover, the doser devices of known type supply a modest water flow due to the interruption system and the simple interposition of a filtering cartridge inside them, with its resistance to water passage, would impair their functionality.

Finally, it is evident that the filtering devices installed between cold tank and boiler in appliances provided with pump for boiler filling can only be provided for this type of steam appliances and, in any case, do not avoid the formation of scale in the cold tank.

The main purpose of the present invention is to provide a device designed to pour the necessary amount of water in the boiler for correct filling, without the risk of causing undesired water overflowing outside the boiler or vice versa insufficiently filling the boiler, and to soften the water, removing scale while pouring.

The present invention has been devised to relieve the operator from any type of control activity when filling the boiler of any steam appliance. The purpose of the invention is to devise a water container provided with means to soften water and simultaneously measure out the water introduced in said container, where said dosing means are calibrated according to the boiler in which the device of the invention is provided, and capable of automatically interrupting water pouring as soon as the water level inside the boiler reaches the correct predefined filling height.

All the above purposes have been achieved by the device of the present invention, the main characteristics of which are disclosed in the first independent claim.

The device of the invention comprises a tank adapted to be filled with water, provided with a lower opening closed by a screened cartridge, filled with water softening agent, such as ionic exchange resins, and housed in a tight chamber where the filtered softened water dripping from said cartridge is poured by simple gravity.

The water drain hole is obtained in the centre of the bottom wall of said tight chamber and closed by a shut-off plate applied on top of a drain pipe with vertical axis, where water is conveyed and flows down every time the plate is raised inside the tight chamber with consequent opening of said drain hole. It must be noted that said drain pipe will be hereinafter defined as double drain pipe because it is internally divided into two parts by a longitudinal partition that separates two adjacent parallel conduits, the first one being adapted to convey the water that surpasses said drain hole, and the second one being adapted to convey air inside the tank, and more precisely above the free water surface inside said tank.

Evidently, if said double drain pipe is inserted from up down inside the filling hole of the boiler and said shut-off plate is raised manually, then the water conveyed in said tight chamber, situated downstream the cartridge, spontaneously starts pouring by gravity inside said first conduit and then inside the boiler; however, said pouring will be automatically interrupted as soon as the water level inside the boiler raises to a suitable height to intercept the lower opening of said second conduit, with consequent interruption of the ascending air flow that ends inside the water tank.

For purposes of clarity, the description of the device according to the present invention continues with reference to the enclosed drawings, which only have an illustrative, not limiting purposes, wherein.

Figure 1:
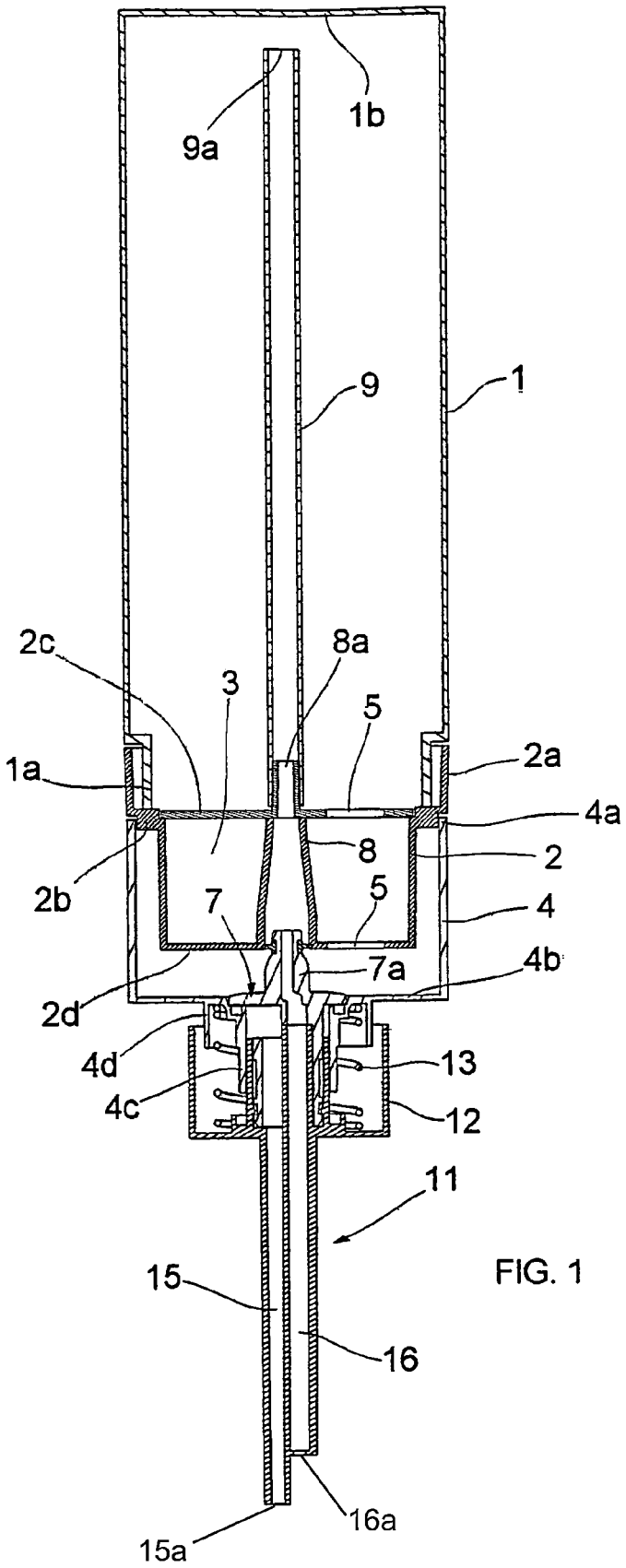
FIG. 1 is a sectional view of the device of the invention with a vertical plane passing through the longitudinal axis of said tank; in this figure the shut-off plate of the drain pipe is shown in closed position.
Figure 2:
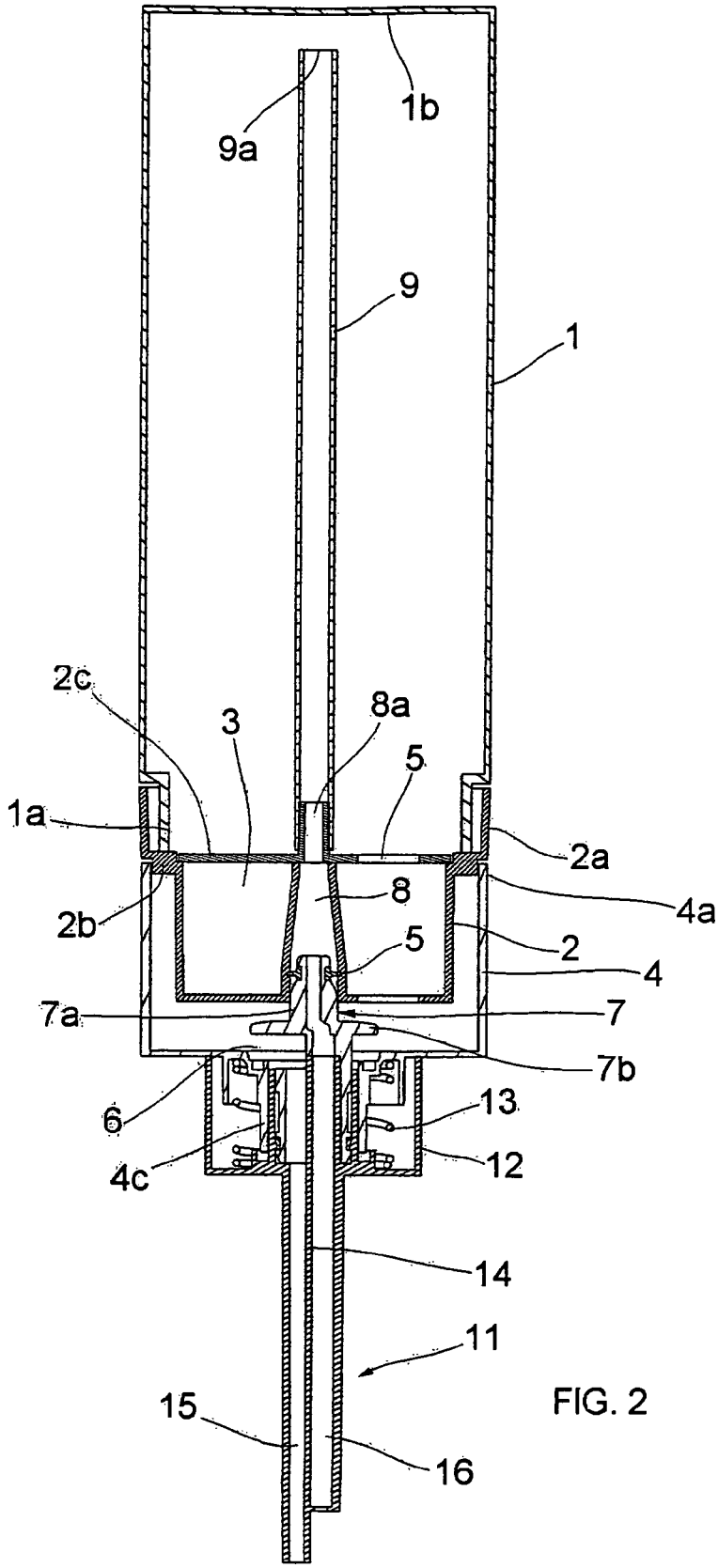
FIG. 2 is a sectional view of the device of the invention with a vertical plane passing through the longitudinal axis of said tank; in this figure the shut-off plate of the drain pipe is shown in open position.
Figure 3:
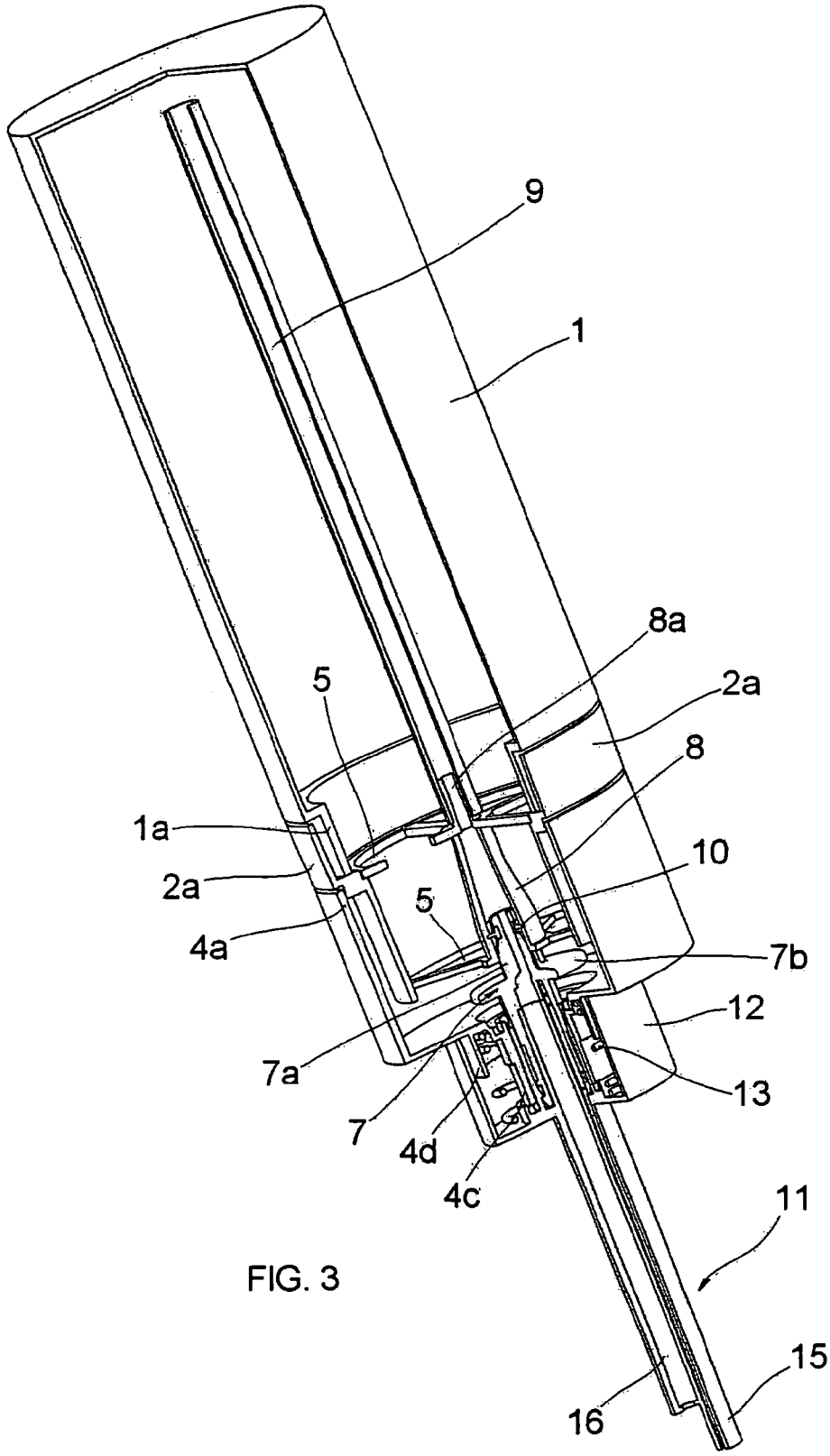
FIG. 3 is an axonometric view of the device of the invention, in which a sector has been removed to show the position and configuration of its internal components.

Referring to the aforementioned figures, the device of the invention comprises a cylindrical tank (1) adapted to be filled with water through the lower opening (1*a*) that is closed by means of a screened cartridge (2), filled with water softening agent (3), such as for instance ionic exchange resins.

According to the preferred embodiment of the invention, which is shown in the enclosed figures, said cartridge (2) is circular and provided with an upper collar (2*a*) for tight engagement externally to the opening (1*a*) of the tank (1). Said cartridge (2) is housed in a tight chamber (4) shaped as a cylindrical bowl, the upper opening (4*a*) of which is in turn tight-coupled with a flange (2*b*) obtained in external position on the body of the cartridge (2).

It must be noted that the body of the cartridge (2) is composed of a cylindrical shell (2), closed by an upper bottom (2*c*) and a lower bottom (2*d*), both provided with holes (5) through which the water contained in the tank (1) can be poured by gravity into the tight chamber (4) after passing through the resins (3) contained in a woven microfilter not shown in the enclosed figures.

A drain hole (6) is obtained in the centre of the bottom wall (4*b*) of the chamber (4), with a concentric pair of circular drain nozzles (4*c* and 4*d*) provided in external position on the drain hole (6), both being obtained from the same piece with the chamber (4).

The drain hole (6) is closed by a shut-off plate (7) formed of a central tubular body (7*a*) with vertical axis, which is provided at approximately half of its height with an external circular flange (7*b*) that is directly responsible for closing the drain hole (6).

The upper ending section of said tubular body (7*a*) is inserted in a conduit (8) with vertical axis that crosses the cartridge (2) axially and ends on top with a nozzle (8*a*) that extends inside the tank (1).

The nozzle (8) is provided with a pipe (9), the upper opening (9*a*) of which is situated at a short distance from the upper bottom (1*b*) of the tank (1).

Attention is drawn on the fact that said upper ending section of the tubular body (7*a*) is coupled with said conduit (8) with possibility of axial sliding, of up-down type, said coupling being a tight coupling by means of a gasket ring (10) mounted in external position on the upper ending section of the tubular body (7*a*) and sliding inside the conduit (8). A double discharge pipe (11) is fitted under the lower ending section of said tubular body (7*a*) of the plate (7), being perfectly inserted with possibility of up-down sliding in the first smaller nozzle (4*c*) of said concentric pair of drain nozzles (4*c* and 4*d*).

Said double pipe (11) is provided on top with a cup-shaped external collar (12) that houses a pre-compressed spring (13) inserted in the annular space defined by the concentric pair of drain nozzles (4*c* and 4*d*).

In view of the above, said double pipe (11), just like the plate (7) joined to it, is constantly subjected to a downward thrust that ensures the permanent closing of the drain hole (6) by the plate (7).

As mentioned above, said double pipe (11) is internally divided in two parts by a longitudinal partition (14) that separates two adjacent parallel conduits, the first one (15) being adapted to convey the water that surpasses said drain hole (6), and the second one (16) being adapted to convey air inside said water tank (1).

More precisely, said second conduit (16) is coupled with the lower ending section of the tubular body (7*a*) of the plate (7) in such a way that the conduit (16) continues first inside the tubular body (7*a*), then inside the conduit (8) and finally inside the pipe (9).

Said first conduit (15) is in off-centred external position with respect to the tubular body (7*a*) of the plate (7), so that all the water passing through the drain hole (6) is poured inside the first conduit (15), the base ending section (15*a*) of which is situated at a lower height than the base ending section (16*a*) of the air conduit (16).

Finally, it must be noted that the opening of the drain hole (6) can be obtained easily by exerting a down-up pressure under the cup-shaped collar (12) to overcome the resistance of the spring (13) and consequently raise the conduit (11) and the plate (7) with it.

As soon as said pressure ceases, the plate is automatically lowered by means of the return action of the spring (13) during extension.

In view of the aforementioned description, evidently, if said double drain pipe (11) is inserted from up down inside the filling hole of the boiler of a household appliance and if said shut-off plate (7) is raised, then the water conveyed in said tight chamber (4) situated downstream the cartridge (2), spontaneously starts pouring by gravity inside said first conduit (15) and then inside the boiler; however, said pouring will be automatically interrupted as soon as the water level inside the boiler raises to a suitable height to intercept the lower opening (16*a*) of said second conduit, with consequent interruption of the ascending air flow that ends inside the water tank (1).

Evidently, the correct dosing of filling water can be actuated for each model of boiler by simply selecting the correct length of the second conduit (16) measured starting from the base section (16*a*) to the cup-shaped collar (12), being aware that said cup-shaped collar (12) is engaged and pressed against the opening of the boiler during the use of the device of the to invention.

Now attention is drawn on the importance of positioning the base ending section (15*a*) of the first conduit (15) at a lower height than the base ending section (16*a*) of the air conduit (16).

In this way, the risk for the water coming out of the base ending section (15*a*) to be sucked into the conduit (16) by means of the suction, although very small, exerted by the air vent flow that raises through the conduit (16) until it ends on top of the tank (1), after crossing the entire pipe (9), the presence of which is fundamental for rapid water pouring from the tank (1) to the chamber (4) regardless of the load losses due to passage through the resin layer (3).

In lack of said pipe (9), the vent air coming from the boiler would come out on top through the nozzle (8*a*) bubbling in the mass of water contained in the tank (1). Said water could partially be conveyed inside the nozzle (8*a*), thus by-passing the cartridge (2) and slowing down the descending travel of the water through the cartridge (2) due to the fact that said vent air encounters more difficulties in continuously and instantaneously restoring the atmospheric pressure in the air chamber that is situated above the free surface of the water inside the tank (1).

Figure 4:
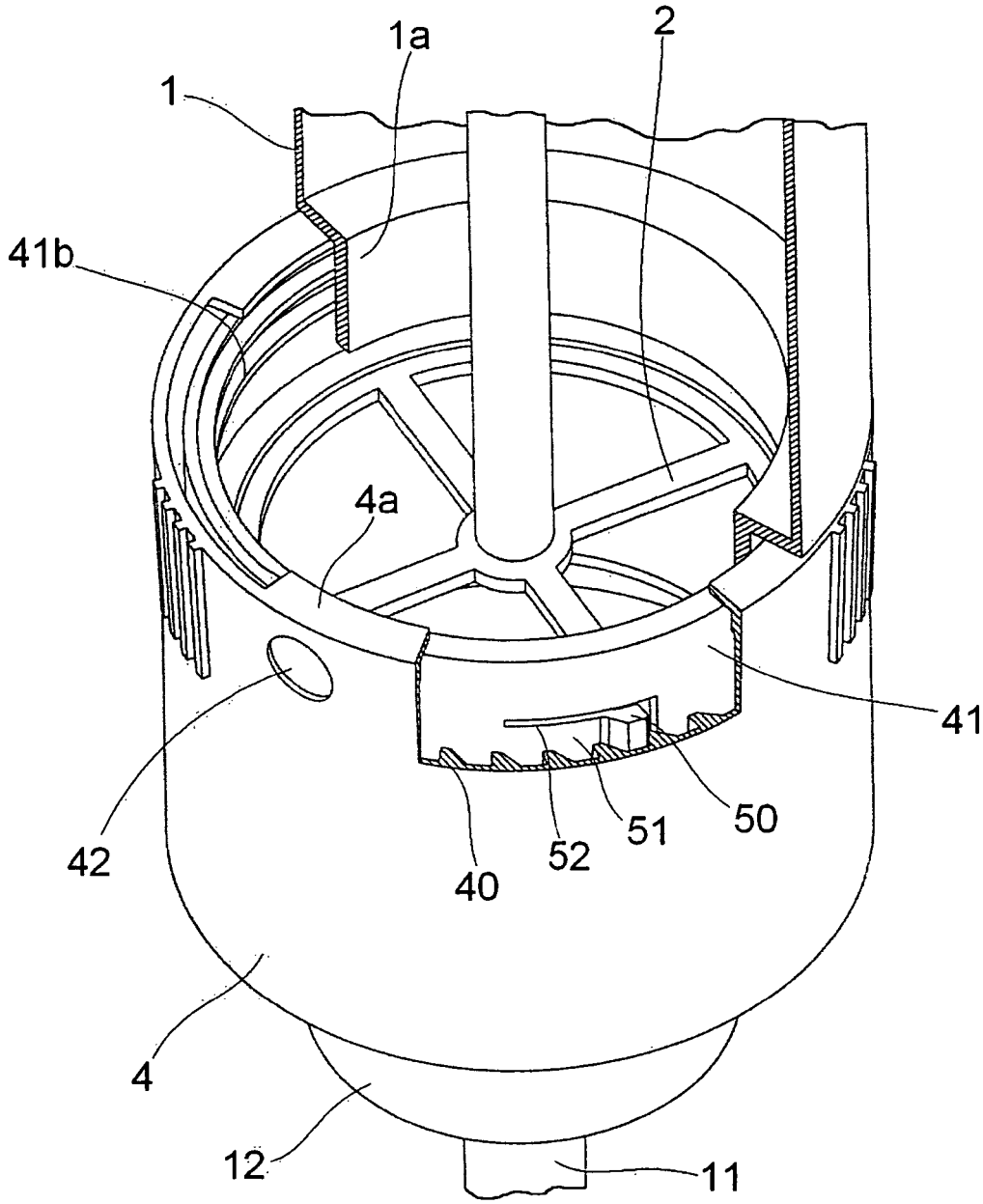
FIG. 4 is a view of a different embodiment of the device of the invention.

Attention is drawn on an alternative embodiment of the invention, which differs from the one described above only in that it comprises a collar (41) situated between the tight chamber (4) and the opening (1*a*) of the tank (1). Referring to FIG. 4, according to this alternative embodiment of the invention, a toothed crown (40) is obtained in the opening (4*a*) of the tight chamber (4), on which a catch (50) can jump, protruding in external position on an elastically flexible tongue (51) obtained by means of a C-shaped notch (52) on said cylindrical collar (41), which is inserted inside the opening (4*a*) at a higher height than the cartridge (2)

The lateral surface of said collar (41) is provided with a numeric scale, not shown in FIG. 4, which shows the number of fillings or simply with a graphic symbol that inform the need to replace the cartridge (2).

In fact, said graphic symbol or the progressive digits of said scale can be read by the user through a hermetic observation window (42) obtained on the external wall of the tight chamber (4).

This allows for remembering the number of boiler fillings, in order to regenerate or replace the agent (3) contained in the cartridge (2), since said agent loses efficacy after a predefined number of washings, which practically is corresponds to the number of boiler fillings.

The cylindrical collar (41) is provided with internal thread (41*b*) adapted to engage with the lower opening (1*a*) of the tank (1).

Said thread (41) provides tightening of the tank (1) with the component assembly, comprising the tight chamber (4), cartridge (2), cup-shaped collar (12) and double pipe (11).

The user must simply grab the tight chamber (4) ands turn it around the opening (1*a*) of the tank (1); until screwing is not completed, the tight chamber (4) turns together with the collar (41), which naturally stops when screwing has reached the stop, whereas the tight chamber (4) is still free to continue its rotational travel, with the only interference of said catch (50).

At the end of tightening, the user will hear a click, being the click caused by the catch (50) when it passes over one of the teeth of the toothed crown (40); after each click, the user will have to pay attention to the symbol or digit displayed in the observation window (42), since the reading of said digit or the vision of said symbol will tell the user when it is necessary to replace or regenerate the cartridge (2).

The invention claimed is:

1. A device for dosed transfer of filtered softened water into boilers of household appliances, said device comprising:

a tank adapted to be filled with water, the tank having a lower opening;

a double drain pipe having a vertical axis, formed of adjacent first and second conduits;

a bowl having an upper opening and a bottom wall defining a drain hole;

the double drain pipe being situated downstream said drain hole which is configured to be closed by a shut-off plate closable by return action of a spring;

the shut-off plate being fixed at the top of the double pipe and having a central tubular body with a vertical axis;

the central tubular body including an external circular flange at approximately half of its height defining the shut-off plate for closing the drain hole, an upper ending section, and a lower ending section; and a screened cartridge adapted to include a water softening agent, the screened cartridge closing the lower opening of the tank and being housed in a chamber defined by the bowl;

wherein the upper ending section of the tubular body is inserted in a third conduit having a vertical axis that crosses the cartridge axially;

the third conduit has a top ending with a nozzle that extends inside the tank; and the second conduit is coupled with the lower ending section of the central tubular body so that the second conduit is in communication with the third conduit.

2. The device according to claim 1, wherein the upper ending section of the central tubular body is slidably movable up and down and coupled with the third conduit by a gasket ring between the upper ending section of the central tubular body and the third conduit.

3. The device according to claim 1, wherein the nozzle is provided with a pipe with an upper opening spaced away from an upper end of the tank.

4. The device according to claim 1, wherein the first conduit is in an off-centered external position with respect to the central tubular body so that all the water passing through the drain hole is adapted to be poured inside the first conduit.

5. The device according to claim 1, wherein the first conduit has a base ending section, the second conduit has a base ending section, and the base ending section of the first conduit is situated at a lower height than the base ending section of the second conduit.

6. The device according to claim 1, wherein the cartridge is circular and provided with an upper collar for engaging externally to the opening of the tank.

7. The device according to claim 1, wherein the bowl is shaped as a cylindrical bowl with the upper opening coupled with a flange in an external position on the cartridge.

8. The device according to claim 1, further comprising first and second concentric circular walls, wherein the first and second circular walls are positioned in an external position surrounding the drain hole and formed with the bottom wall of the bowl in one piece.

9. The device according to claim 8, wherein a diameter of the first circular wall is smaller than that of the second circular wall, and the double pipe is slidably moveable in the first circular wall.

10. The device according to claim 8, wherein the double drain pipe is provided with a cup-shaped external collar that houses the spring, wherein an upper end of the spring is inserted in an annular space defined by the first and second circular walls.

11. The device according to claim 1, further comprising a cylindrical collar situated between the bowl and the lower opening of the tank, said cylindrical collar including a notch, an elastically flexible tongue in the notch, and a catch protruding externally from the tongue, wherein the upper opening of the bowl includes a toothed crown that is engageable with the catch, the cylindrical collar has an internal lateral surface having an internal thread that engages the lower opening of the tank, and the cylindrical collar further has an external lateral surface having a numeric scale or a graphic symbol, adapted to be seen through a hermetic observation window of the bowl.

* * * * *